United States Patent [19]

Emert et al.

[11] Patent Number: 5,049,290

[45] Date of Patent: Sep. 17, 1991

[54] AMINE COMPATIBILITY AIDS IN LUBRICATING OIL COMPOSITIONS

[75] Inventors: Jacob Emert, Brooklyn, N.Y.; Malcolm Waddoups, Westfield, N.J.

[73] Assignee: Exxon Chemical Patents Inc., Linden, N.J.

[21] Appl. No.: 507,690

[22] Filed: Apr. 10, 1990

Related U.S. Application Data

[62] Division of Ser. No. 48,722, May 11, 1987, Pat. No. 4,915,857.

[51] Int. Cl.[5] ..... C10M 137/10

[52] U.S. Cl. ..... 252/32.7 E; 252/36; 252/37; 252/49.7; 252/51.5 A; 252/56 R

[58] Field of Search ..... 252/32.7 E, 49.7, 36, 252/37, 51.5 A, 56 R

[56] References Cited

U.S. PATENT DOCUMENTS

| | | | |
|---|---|---|---|
| 2,560,542 | 7/1951 | Bartleson et al. | 252/32.7 |
| 2,567,023 | 9/1951 | Morway et al. | 260/399 |
| 2,729,691 | 1/1956 | DePree | 268/809 |
| 3,271,310 | 9/1966 | LeSuer | 252/35 |
| 3,281,428 | 10/1966 | LeSuer | 260/326.3 |
| 3,282,955 | 11/1966 | LeSuer | 260/326.3 |
| 3,284,410 | 11/1966 | Meinhardt | 252/49.6 |
| 3,312,619 | 4/1967 | Vineyard | 252/47.5 |
| 3,338,832 | 8/1967 | LeSuer | 252/47.5 |
| 3,711,406 | 1/1973 | Lowe | 252/33.4 |
| 4,122,033 | 10/1978 | Black | 252/400 |
| 4,161,451 | 7/1979 | Lowe | 252/32.7 |
| 4,234,435 | 11/1980 | Meinhardt et al. | 252/51.5 |
| 4,328,113 | 5/1982 | Horodysky et al. | 252/50 |
| 4,409,000 | 10/1983 | LeSuer | 44/70 |
| 4,502,970 | 3/1985 | Schetelich et al. | 252/32.7 |
| 4,552,677 | 11/1985 | Hopkins | 252/33.6 |
| 4,664,822 | 5/1987 | Hunt et al. | 252/37 |
| 4,762,628 | 8/1988 | Sale et al. | 252/51.5 |
| 4,767,551 | 8/1988 | Hunt et al. | 252/32.7 |
| 4,867,890 | 9/1989 | Colclough et al. | 252/51.5 A |

FOREIGN PATENT DOCUMENTS

| | | |
|---|---|---|
| 0024146 | 2/1981 | European Pat. Off. . |
| 0092946 | 11/1983 | European Pat. Off. . |
| 0145469 | 12/1980 | German Democratic Rep. . |
| 0145470 | 12/1980 | German Democratic Rep. . |

*Primary Examiner*—Jacqueline V. Howard
*Attorney, Agent, or Firm*—J. B. Murray, Jr.

[57] ABSTRACT

This invention is to lubricating or fuel oil compositions containing amine compatibility aids.

The amine compatibility additives are especially useful in stabilizing (or "compatibilizing") concentrates, lubricating oil or fuel oil compositions which contain copper antioxidants, high molecular weight dispersants, high total base number detergents, and various antiwear friction modifier materials. These materials may, in some circumstances, replace at least a portion of previously used compatibility aids and antioxidants.

41 Claims, No Drawings

AMINE COMPATIBILITY AIDS IN LUBRICATING OIL COMPOSITIONS

This is a division of application Ser. No. 48,722, filed 5/11/87, now U.S. Pat. No. 4,915,857.

FIELD OF THE INVENTION

This invention is to lubricating oil compositions containing amine compatibility aids.

The amine compatibility additives are especially useful in stabilizing (or "compatibilizing") concentrates and lubricating oil or fuel oil compositions which contain high molecular weight dispersants, high total base number detergents, friction modifiers, and various antiwear or antioxidant materials. These amines, may, in some circumstances, be useful in replacing at least a portion of previously used compatability aids and antioxidants. They are particularly suitable for stabilizing compositions which contain copper carboxylate antioxidants and friction modifiers.

BACKGROUND OF THE INVENTION

Modern lubricating oil and fuel oil compositions are complex mixtures of interacting components. No longer is a single material or simple mixture of natural materials appropriate to lubricate a small internal combustion engine. A variety of minor amounts of additives are included in fuel and lubricants to solve particular problems. For instance, dispersants are included in lubricating oil formulations to "disperse" solids formed during engine operation. Basic detergents are included to react with acidic components produced from the sulfur and nitrogen oxides generated during combustion and to prevent rusting of engine parts. Antioxidants and antiwear agents are added to reduce the oxidation rate of the lube base stock and inhibit wearing of the metal surfaces. Friction modifiers may be added to enhance fuel economy. Viscosity modifiers provide correct viscometric balance.

The various carefully tailored components (e.g., detergent, antioxidant, antiwear agent and friction modifiers) of such formulations often interact when mixed in the "concentrates" mentioned above. It is an object of research in this technology to reduce these interactions by careful choice of complementary additives, but that is not always possible. It is an additional object of research in this area to provide "repairs" to an otherwise suitable additive package with multiple utility. That is to say that an auxiliary additive designated as a material to help specifically with interaction problems should desirably have useful antioxidant or dispersion or detergent properties by itself.

The invention here entails the addition of certain amines to lubricating or fuel oil compositions which contain, inter alia, dispersants, detergents and copper antioxidants for the purpose of stabilizing the compositions against phase separation. The added amines may also be suitable as antioxidants in their own right.

European Patent 24,146 relates to copper antioxidants in lubricating oil compositions. The copper antioxidants are disclosed as useful in combination with ashless dispersants, overbased metal detergents and zinc dialkyl dithiophosphate antiwear additives. It is disclosed that while the inclusion of small amounts of the patentee's copper antioxidants generally removes the need for conventionally-used supplementary antioxidants, such supplementary antioxidants could be used especially for oils operating under particularly severe conditions. The disclosed supplementary antioxidants, which are added to the oil in amounts of from 0.5 to 2.5 wt. %, are indicated to include diphenyl amine and alkyl diphenylamines, phenyl-1-naphthyl amine and its alkylated derivatives (e.g., alkylated diphenyl amine, "Octamine").

Copper compounds have been added to such compositions for a variety of other reasons. For instance, the prior art recognizes that copper components per se can be favorable friction reducing agents in certain circumstances. German Democratic Republic Pat. Nos. 145,469 and 145,470 disclose the reduction of wear and friction in iron/iron and iron/bronze friction interfaces using polyol or mineral oil lubricants containing copper compounds such as copper naphthenate, copper octanoate, copper stearate and reaction products of the lubricants themselves with copper, copper oxide and copper salts of inorganic acids. These references indicate that the friction reduction is achieved by the deposition, on the substrate being lubricated, of a film reaction layer of copper with adequate adhesion properties. It is recommended in these references that the concentration of the copper compound in the lubricant provide a copper content of 0.001 to 5 volume % relative to the lubricant. These references however did not evaluate lubricating oil compositions for internal combustion engines.

European published Application Number 92,946, published Nov. 7, 1983, is directed to the combination of glycerol esters with oil-soluble copper compounds as fuel economy additives.

Various U.S. patents suggest the addition of copper bearing materials to oil compositions include:

U.S. Pat. No. 2,560,542, Bartleson et al.
U.S. Pat. No. 2,567,023, Morway
U.S. Pat. No. 3,271,310, LeSuer
U.S. Pat. No. 4,234,435, Meinhardt et al.
U.S. Pat. No. 4,552,677, Hopkins U.S. Pat. Nos. 3,338,832 and 3,281,428 relate to oil soluble N- and B- containing compositions obtained by (i) reacting a substantially hydrocarbon-substituted succinic-acid producing compound (having at least about 50 aliphatic carbons in the hydrocarbon substituent) with at least one-half equivalent of a compound of the formula:

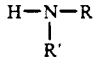

wherein R is H or hydrocarbyl and R′ is amino, cyano, carbamyl or guanyl, to form an acylated nitrogen intermediate, and (ii) reacting this intermediate with a boron compound. Similar compositions are prepared in U.S. Pat. No. 3,282,955 (hydroxyhydrocarbyl-substituted primary and secondary amines) and U.S. Pat. No. 3,284,410 (cyanamido compounds of the formula R′N(R)—CN, wherein R is H or alkyl and R′ is H, alkyl or guanyl).

U.S. Pat. No. 3,312,619 relates to the reaction products formed by reacting a polyalkenylsuccinic anhydride with a polyalkylene-polyamine, to form a succinimide which is then reacted with e.g., equimolar amounts of, a urea, thiourea or guanidine of the structure:

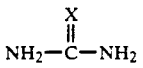

wherein X is O, S or NH.

U.S. Pat. No. 3,711,406 relates to poly (hydroxyalkylated) amines combined with alkaline earth metal carbonates, as rust inhibitors in internal combustion engines, in combination with dispersants, such as overbased sulfonates or phenates or succinimides of alkylene polyamines. U.S. Pat. No. 4,409,000 relates to combinations of certain hydroxy amines and hydrocarbonsoluble carboxylic dispersants as engine and carburetor detergents for normally liquid fuels, and indicates that the dispersant may comprise reactions of a polyalkylene succinimide with a large number of reactive metal compounds, including cupric acetate. The usual weight ratio of the dispersant to the hydroxyamine is disclosed to be between about 1:1 and about 8:1.

None of these references teach the combination of a copper bearing material and an amine in a hydrocarbon base for any reason and certainly not for the purposes of this invention.

SUMMARY OF THE INVENTION

This invention is to compositions containing medium to high molecular weight amine compatibility aids.

The candidate amines are of the general formula $R^1R^2NH$ wherein $R^1$ and $R^2$ may independently be the same or different H or hydrocarbyl groups having from 4 to 20 carbons atoms, preferably 8 to 18 carbon atoms, with the proviso that at least one of $R^1$ and $R^2$ is hydrocarbyl. The hydrocarbyl groups may be alkyl, alkenyl, aryl, aralkyl, alkaryl or cycloaliphatic.

The hydrocarbyl groups may be substituted if the substituents do not interfere with the compatibility function. The total number of carbon atoms in the amine should be 8 or more to improve oil solubility.

These materials are useful as compatibility aids in reducing interaction between the various components of concentrated additive packages used in producing motor oils and in the lubricating oils themselves.

They are particularly useful as compatibility aids in lubricating compositions containing high molecular weight ashless dispersants, high total base number detergents and copper antioxidants, optionally with friction modifiers and antiwear agents. Compatibility has proven to be a particular problem in lubricating compositions or concentrates for those compositions containing both copper carboxylate antioxidants and friction modifiers. It is imperative for concentrates containing these additives to remain in a single homogenous phase even at elevated temperatures. Because of the concentrates' high viscosity, they are typically stored at high temperatures to improve handling and pumping. The amine compatibility agents have proven effective in providing substantial compatibility improvement even after storage at elevated temperatures.

DETAILED DESCRIPTION OF THE INVENTION

Lubricating oil compositions, e.g., automatic transmission fluids, heavy duty oils suitable for gasoline and diesel engines, etc., can be prepared using the compositions of this invention. Universal type crankcase oils, those in which the same lubricating oil composition is used for either gasoline or diesel engines, may also be prepared. These lubricating oil formulations conventionally contain several different types of additives that will supply the characteristics that are required for the particular use. Among these additives are included viscosity index improvers, antioxidants, corrosion inhibitors, detergents, dispersants, pour point depressants, antiwear agents, etc.

In the preparation of lubricating oil formulations, it is common practice to introduce the additives in the form of a concentrate (for instance, as an "ad pack") containing 10 to 80 weight percent, e.g., 20 to 70 weight percent, active ingredient in a solvent. The solvent may be a hydrocarbon oil, e.g., a mineral lubricating oil, or other suitable material. In forming finished lubricants, such as crankcase motor oils, these concentrates, in turn, may be diluted with 3 to 100, e.g., 5 to 40, parts by weight of lubricating oil per part by weight of the additive package. One uses concentrates, of course, to make the handling of the various constituent materials less difficult as well as to facilitate solution or dispersion of those materials in the final blend. Blending a lubricating oil composition containing several types of additives typically causes no problems if each additive is added separately. However, when an additive "package" having a number of additives in a single concentrate is to be used, the additives may interact with each other in the concentrate form. For instance, high molecular weight dispersants have been found to interact with various other additives in the formulations, particularly, with overbased metal detergents and antioxidants, such as copper oleate. These interactions become even more acute when antiwear additives, such as zinc dialkyl dithiophosphates, and friction modifiers such as glycerol partially esterified with fatty acids are also present in the composition. This interaction may take the form of a phase separation in which solids separate from the composition during subsequent storage especially if that storage is at a high temperature. Obviously, this hampers pumping, blending and handling of both the concentrate and the resulting product. Although the concentrate may be further diluted to reduce the interaction effect, the dilution increases the shipping, storage and handling costs. The compatibility agents discussed below substantially alleviate these separation problems.

THE COMPOSITIONS

Compositions made according to this invention generally will contain an oil of lubricating viscosity and:

a. at least one high molecular weight ashless dispersant;

b. at least one detergent having a high total base number;

c. at least one copper containing antioxidant; and d. at least one amine compatibility agent.

These amine compatibility agents are especially useful in stabilizing compositions also containing antiwear additives, particularly zinc dihydrocarbyl dithiophosphate antiwear additives.

The additives employed in the stabilized compositions of this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular dispersant, if desired.

Accordingly, while any effective amount of the additives can be incorporated into the lubricating oil composition, it is contemplated that such effective amount be sufficient to provide said lube oil composition with an amount of the total such additives of typically from about 0.10 to about 15 e.g., 0.1 to 10, and preferably from about 0.1 to about 7 wt. %, based on the weight of said composition.

The additives of the present invention can be incorporated into the lubricating oil in any convenient way. Thus, they can be added directly to the oil by dispersing, or dissolving the same in the oil at the desired level of concentration typically with the aid of a suitable solvent such as toluene, or tetrahydrofuran. Such blending can occur at room temperature or elevated temperatures. Alternatively, the additives may be blended with a suitable oil-soluble solvent and base oil to form a concentrate, and then blending the concentrate with lubricating oil base stock to obtain the final formulation. Concentrates will typically contain from about 20 to about 60 wt. %, by weight total additives, and typically from about 80 to about 20%, preferably from about 60 to about 20% by weight base oil, based on the concentrate weight.

Dissolution of the stabilized additive concentrates of this invention into the lubricating oil may be facilitated by solvents and by mixing accompanied with mild heating (e.g., at 50° to 75° C.), but this is not essential. The concentrate or additive-package will typically be formulated to contain the additives in proper amounts to provide the desired concentration in the final formulation when the additive-package is combined with a predetermined amount of base lubricant. Thus, the stabilized concentrates of the present invention can be added to small amounts of base oil or other compatible solvents along with other desirable additives to form additive-packages containing active ingredients in collective amounts of typically from about 2.5 to about 90%, and preferably from about 5 to about 75%, and most preferably from about 8 to about 50% by weight additives in the appropriate proportions with the remainder being base oil.

The final formulations may employ typically about 10 wt. % of the additive-package with the remainder being base oil.

All of said weight percents expressed herein are based on active ingredient (A.I.) content of the additive, and/or upon the total weight of any additive-package, or formulation which will be the sum of the A.I. weight of each additive plus the weight of the total oil or diluent.

Depending upon the use to which the compositions are ultimately placed, the compositions may also include friction modifiers, pour point depressants, viscosity index improvers and the like.

When the compositions of the invention are used in the form of lubricating oil compositions, such as automotive crankcase lubricating oil compositions, a major amount of a lubricating oil may be included in the composition. Broadly, the composition may contain about 80 to about 99.99 weight percent of a lubricating oil. Preferably, about 93 to about 99.8 weight percent of the lubricating oil. The term "lubricating oil" is intended to include not only hydrocarbon oils derived from petroleum but also synthetic oils such as alkyl esters of dicarboxylic acids, polyglycols and alcohols, polyalphaolefins, alkyl benzenes, organic esters of phosphoric acids, polysilicone oils, etc.

When the compositions of this invention are provided in the form of concentrates, with or without the other noted additives up to about 70 percent by weight, of a solvent, mineral, or synthetic oil may be included to enhance the handling properties of the concentrate.

When the compositions of this invention are used in normally liquid petroleum fuels such as gasoline, and middle distillates boiling from about 65° C. to 430° C., including kerosene, diesel fuels, home heating fuel oil, jet fuels, etc., a concentration of the additive in the fuel in the range of 0.001 to 0.5, preferable about 0.001 to 0.1 weight percent, based on the weight of the total composition, will usually be employed.

A. THE DISPERSANT

Ashless dispersants useful in this invention comprise nitrogen or ester containing dispersants selected from the group consisting of (i) oil-soluble salts, amides, imides, oxazolines and esters, or mixtures thereof, of long chain hydrocarbon substituted mono- and dicarboxylic acids or their anhydrides; (ii) long chain aliphatic hydrocarbon having a polyamine attached directly thereto; and (iii) Mannich condensation products formed by condensing about a molar proportion of a long chain substituted phenol with about 1 to 2.5 moles of formaldehyde and about 0.5 to 2 moles of polyalkylene polyamine; wherein said long chain hydrocarbon group in (i), (ii) and (iii) is a polymer of a $C_2$ to $C_{10}$, e.g., $C_2$ to $C_5$, monoolefin, said polymer having a number average molecular weight of about 300 to 5000.

A(i): The long chain hydrocarbyl substituted mono- or dicarboxylic acid material, i.e. acid, anhydride, or ester, used in the invention includes long chain hydrocarbon, generally a polyolefin, substituted with an average of at least about 0.8, generally from about 0.8 to 2.0, preferably 1.05 to 1.6, more preferably 1.06 to 1.25, most preferably 1.10 to 1.20 moles, per mole of polyolefin, of an alpha or beta unsaturated $C_4$ to $C_{10}$ dicarboxylic acid, or anhydride or ester thereof, such as fumaric acid, itaconic acid, maleic acid, maleic anhydride, chloromaleic acid, dimethyl fumarate, chloromaleic anhydride, acrylic acid, methacrylic acid, crotonic acid, cinnamic acid, and mixtures thereof.

Preferred olefin polymers for the reaction with the unsaturated dicarboxylic acids are those polymers made up of a major molar amount of $C_2$ to $C_{10}$, e.g., $C_2$ to $C_5$, monoolefin. Such olefins include ethylene, propylene, butylene, isobutylene, pentene, octene-1, styrene, etc. The polymers may be homopolymers such as polyisobutylene or copolymers of two or more of such olefins. These include copolymers of: ethylene and propylene; butylene and isobutylene; propylene and isobutylene; etc. Other copolymers include those in which a minor molar amount of the copolymer monomers, e.g., 1 to 10 mole percent is a $C_4$ to $C_{18}$ diolefin, e.g., copolymer of isobutylene and butadiene; or a copolymer of ethylene, propylene and 1,4-hexadiene; etc.

In some cases, the olefin polymer may be completely saturated, for example an ethylene-propylene copyright made by a Ziegler-Natta synthesis using hydrogen as a moderator to control molecular weight.

The olefin polymers will usually have number average molecular weights above about 700, and preferably from about 800 to about 5000. Particularly useful olefin polymers have number average molecular weights within the range of from about 1,300 to about 5,000, e.g., of from about 1,500 to 3,000 with approximately one double bond per polymer chain. An especially suitable starting material for a dispersant additive is polyisobutylene. The number average molecular weight for such polymers can be determined by several known techniques. A convenient method for such determination is by gel permeation chromatography (GPC) which additionally provides molecular weight distribution information, see W. W. Yau, J. J. Kirkland and D. D. Bly, "Modern Size Exclusion Liquid Chromatography", John Wiley and Sons, New York, 1979.

Processes for reacting the olefin polymer with the $C_4$ to $C_{10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Or, the olefin polymer can be first halogenated, for example, chlorinated or brominated to about 1 to 8, preferably 3 to 7 weight percent chlorine, or bromine, based on the weight of polymer, by passing the chlorine or bromine through the polyolefin at a temperature of 60° C. to 250° C., e.g., 120° C. to 160° C. for about 0.5 to 10, preferably 1 to 7 hours. The halogenated polymer may then be reacted with sufficient unsaturated acid or anhydride at 100° C. to 250° C., usually about 180° C. to 220° C. for about 0.5 to 10, e.g., 3 to 8 hours. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. Pat. No. 1,440,219.

By the use of halogen, about 65 to 95 weight percent of the polyolefin will normally react with the dicarboxylic acid material. Thermal reactions, those carried out without the use of halogen or a catalyst, cause only about 50 to 75 weight percent of the polyisobutylene to react. Chlorination helps to increase the reactivity. For convenience, the aforesaid ratios of dicarboxylic acid producing units to polyolefin of 1.05 to 114 and the like, are based upon the total amount of polyolefin, that is, the total of both the reacted and unreacted polyolefin, used to make the product.

The dicarboxylic acid producing materials can also be further reacted with amines, alcohols, including polyols, amino-alcohols, etc., to form other useful dispersant additives. Thus, if the acid producing material is to be further reacted, e.g., neutralized, then generally a major proportion of at least 50 percent of the acid units up to all the acid units will be reacted.

Useful amine compounds for neutralization of the hydrocarbyl substituted dicarboxylic acid material include mono and polyamines of about 2 to 60, e.g., 3 to 20, total carbon atoms and about 1 to 12, e.g., 2 to 9 nitrogen atoms in the molecule. These amines may be hydrocarbyl amines or may be hydrocarbyl amines including other groups, e.g., hydroxy groups, alkoxy groups, amide groups, nitriles, imidazoline groups, and the like. Hydroxy amines with 1 to 6 hydroxy groups, preferably 1 to 3 hydroxy groups are particularly useful. Preferred amines are aliphatic saturated amines, including those of the general formula:

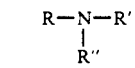

(Ia)

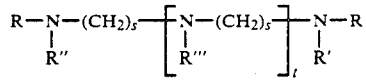

(Ib)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ alkyl-amino $C_2$ to $C_6$ alkylene radicals; and wherein R''' can additionally comprise a moiety of the formula:

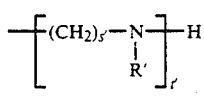

(Ic)

wherein R' is as defined above, and wherein each s and s' can be the same or a different number of from 2 to 6, preferably 2 to 4; and t and t' can be the same or different and are numbers of from 0 to 10, preferably 2 to 7 with the proviso that the sum of t and t' is not greater than 15. To assure a facile reaction, it is preferred that R, R', R'', R''', s, s', t and t' be selected in a manner sufficient to provide the compounds of Formulas Ia and Ib with typically at least one primary or secondary amine group, preferably at least two primary or secondary amine groups. This can be achieved by selecting at least one of said R, R', R'' or R''' groups of to be hydrogen or by letting t in Formula Ib be at least one when R''' is H or when the (Ic) moiety possesses a secondary amino group. The most preferred amine of the above formulas are represented by Formula Ib and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene) triamine; di-(1,3-propylene) triamine; N,N-dimethyl-1,-3-diaminopropane; N,N-di-(2-aminoethyl) ethylene diamine; N,N-di(2-hydroxyethyl)-1,3-propylene diamine; 3 dodecyloxypropylamine; N-dodecyl-1,3-propane diamine; tris hydroxymethylaminomethane (THAM); diisopropanol amine; diethanol amine; triethanol amine; mono-, di-, and tri-tallow amines; amino morpholines such as N-(3-aminopropyl) morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula (II):

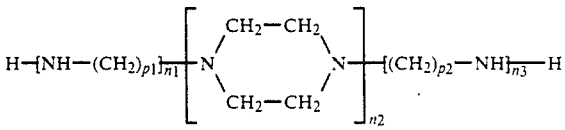

wherein $p_1$ and $p_2$ are the same or different and are each integers of from 1 to 4, and $n_1$, $n_2$ and $n_3$ are the same or different and are each integers of from 1 to 3.

Non-limiting examples of such amines include 2-pentadecyl imidazoline; N-(2-aminoethyl) piperazine; and mixtures thereof.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H," Polyamine 400," "Dow Polyamine E-100," etc.

Useful amines also include polyoxyalkylene polyamines such as those of the formulae:

$$NH_2\text{—alkylene}\left(\text{O-alkylene}\right)_m NH_2 \quad \text{(III)}$$

where m has a value of about 3 to 70 and preferable 10 to 35; and $$R^3\left(\text{alkylene}\left(\text{O-alkylene}\right)_n NH_2\right)_a \quad \text{(IV)}$$

where "n" has a value of about 1 to 40 with the provision that the sum of all the n's is from about 3 to about 70 and preferably from about 6 to about 35 and $R^3$ is a polyvalent saturated hydrocarbon radical of up to ten carbon atoms wherein the number of substituents on the R group is represented by the value of "a", which is a number of from 3 to 6. The alkylene groups in either formula (III) or (IV) may be straight or branched chains containing about 2 to 7, and preferably about 2 to 4 carbon atoms. The polyoxyalkylene polyamines above, preferably polyoxyalkylene diamines and polyoxyalkylene triamines, may have average molecular weights ranging from about 200 to about 4,000 and preferable from about 400 to about 2,000. The preferred polyoxyalkylene polyamines include the polyoxyethylene and polyoxypropylene diamines and the polyoxypropylene triamines having average molecular weights ranging from about 200 to 2,000. The polyoxyalkylene polyamines are commercially available and may be obtained, for example, from the Jefferson Chemical Company, Inc. under the trade name "Jeffamines D-230, D-400, D-1000, D-2000, T-403," etc.

The amine is readily reacted with the dicarboxylic acid material, e.g., alkenyl succinic anhydride, by heating an oil solution containing 5 to 95 weight percent of dicarboxylic acid material to about 100° C. to 250° C., preferable 125° C. to 175° C., generally for 1 to 10, e.g., 2 to 6 hours, until the desired amount of water is removed. The heating is preferably carried out to favor formation of imides or mixtures of imides and amides, rather than amides and salts. Reaction ratios of dicarboxylic material to equivalents of amine as well as the other neucleophilic reactants described herein can vary considerably, depending on the reactants and type of bonds formed. Generally from 0.1 to 1.0, preferably from about 0.2 to 0.6, e.g., 0.4 to 0.6, moles of dicarboxylic acid moiety content (e.g., grafted maleic anhydride content) is used per equivalent of neucleophilic reactant, e.g., amine. For example, about 0.8 mole of a pentaamine (having two primary amino groups and five equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e., preferably the pentaamine is used in an amount sufficient to provide about 0.4 mole (that is, $1.6 \div [0.8 \times 5]$ mole) of succinic anhydride moiety per nitrogen equivalent of the amine.

Preferred dispersants are polyisobutenyl succinimides ("PIBSA-PAM") derived from polyisobutenyl succinic anhydride (derived from a polyisobutene polymer, $\overline{M}_n = 700$ to 5000, more preferably from about 1,300 to 5,000, e.g., from about 1,500 to 3,000) and $C_5$ to $C_9$ polyalkyene polyamine (e.g., tetraethylenepentamine).

The nitrogen-containing dispersant can be further treated by boration as generally taught in U.S. Pat. Nos. 3,087,936 and 3,254,025 (the entirety of which is incorporated by reference). This is readily accomplished by treating said acyl nitrogen dispersant with a boron compound selected from the class consisting of boron oxide, boron halides, boron acids and esters of boron acids in an amount to provide from about 0.1 atomic proportion of boron for each mole of said acylated nitrogen composition to about 20 atomic proportions of boron for each atomic proportion of nitrogen of said acylated nitrogen composition. Usefully the dispersants of the inventive combination contain from about 0.05 to 2.0 weight percent, e.g., 0.05 to 0.7 weight percent, boron based on the total weight of said borated acyl nitrogen compound. The boron, which appears to be in the product as dehydrated boric acid polymer (primarily $(HBO_2)_3$), is believed to attach to the dispersant imides and diimides as amine salts, e.g., the metaborate salt of said diimide.

Treating is readily carried out by adding from about 0.05 to 4, e.g., 1 to 3 weight percent (based on the weight of said acyl nitrogen compound) of said boron compound, preferably boric acid which is most usually added as a slurry to said acyl nitrogen compound and heating with stirring at from about 135° C. to 190° C., e.g., 140° C. to 170° C., for from 1 to 5 hours followed by nitrogen stripping at said temperature ranges. Or, the boron treatment can be carried out by adding boric acid to the hot reaction mixture of the dicarboxylic acid material and amine while removing water.

Tris (hydroxymethyl) amino methane (THAM) can be reacted with the aforesaid acid material to form amides, imides or ester type additives as taught by U.K. Pat. No. 984,409, or to form oxazoline compounds and borated oxazoline compounds as described, for example, in U.S. Pat. Nos. 4,102,798; 4,116,876 and 4,113,639.

The ashless dispersants may also be esters derived from the long chain hydrocarbyl substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 1 hydroxy radicals, for example, ethylene glycol, diethylene glycol, triethylene glycol, tetraethylene glycol, dipropylene glycol, and other alkylene glycols in which the alkylene radical contains from 12 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 11-cyclohexane-33-ol, and oleyl alcohol. Still other classes of the alcohols capable of yielding the esters of this invention comprise the ether-alcohols and amino-alcohols including, for example, the oxy-alkylene-, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N,N,N',N'-tetrahydroxy-trimethylene diamine, and ether-alcohols having up to about 150 oxyalkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022.

Hydroxyamines which can be reacted with the long chain hydrocarbon substituted dicarboxylic acid material mentioned above to form dispersants include: 2-amino-1-butanol; 2-amino-2-methyl-1-propanol; p-(beta hydroxy-ethyl)-aniline;2-amino-1-propanol; 3-amino-1-propanol; 2-amino-2-methyl-1,3-propane-diol; 2-amino-2-ethyl-1,3-propanediol; N-(beta-hydroxy-propyl)-N'-(beta amino-ethyl)-piperazine; tris (hydroxyethyl) amino-methane (also known as trismethylolaminomethane); ethanolamine; beta-(beta-hydroxy-ethoxy)-ethylamine; and the like. Mixtures of these or similar amines can also be employed.

A very suitable ashless dispersant is one derived from polyisobutylene substituted with succinic anhydride groups and reacted with polyethylene amines, e.g., tetraethylene pentamine, pentaethylene hexamine, polyoxyethylene and polyoxypropylene amines, e.g., polyoxypropylene diamine, trismethylolaminomethane and pentaerythritol, and combinations thereof. One preferred dispersant combination involves a combination of (A) polyisobutene substituted with succinic anhydride groups and reacted with (B) a hydroxy compound, e.g., pentaerythritol, (C) a polyoxyalkylene polyamine, e.g., polyoxypropylene diamine, and (D) a polyalkylene polyamine, e.g., polyethylene diamine and tetraethylene pentamine using about 0.3 to about 2 moles each of (B) and (D) and about 0.3 to about 2 moles of (C) per mole of (A) as described in U.S. Pat. No. 3,804,763. Another preferred dispersant combination involves the combination of (A) polyisobutenyl succinic anhydride with (B) a polyalkylene polyamine, e.g., tetraethylene pentamine, and (C) a polyhydric alcohol or polyhydroxy-substituted aliphatic primary amine, e.g., pentaerythritol or trismethylolaminomethane as described in U.S. Pat. No. 3,632,511.

A(ii): Also useful as ashless dispersant in this invention are dispersants wherein a nitrogen-containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

A(iii): Another class of ashless dispersants are nitrogen-containing dispersants which are those containing Mannich base or Mannich condensation products as they are known in the art. Such Mannich condensation products generally are prepared by condensing about one mole of a hydrocarbyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a long chain, high molecular weight hydrocarbon (e.g., $\overline{M}_n$ of 1,000 or greater) on the benzene group or may be reacted with a compound containing such a hydrocarbon, for example, polyalkenyl succinic anhydride as shown in said aforementioned '808, the disclosure of which is incorporated by reference in its entirety.

Other typical materials are described in U.S. Pat. Nos. 3,649,229 and 3,798,165. High molecular weight Mannich base type dispersants, e.g., one having a number average molecular weight greater than about 2000, should be particularly benefited by enhanced stability to phase separation in "ad packs" by being combined with the compatibility aids as described herein.

B. DETERGENTS

Metal-containing rust inhibitors and/or detergents are frequently used with ashless dispersants. Such detergents and rust inhibitors include the metal salts of sulfonic acids, alkyl phenols, sulfurized alkyl phenols, alkyl salicylates, naphthenates, and other oil-soluble mono- and di-carboxylic acids. Highly basic (or "overbased") metal salts, which are frequently used as detergents, appear particularly prone to interaction with the ashless dispersant. Usually these metal-containing rust inhibitors and detergents are used in lubricating oil in amounts of about 0.01 to 10, e.g., 0.1 to 5, wt. %, based on the weight of the total lubricating composition. Marine diesel lubricating oils typically employ such metal-containing rust inhibitors and detergents in amounts of up to about 20 wt. %.

Highly basic alkaline earth metal sulfonates are frequently used as detergents. They are usually produced by heating a mixture comprising an oil-soluble sulfonate or alkaryl sulfonic acid, with an excess of alkaline earth metal compound above that required for complete neutralization of any sulfonic acid present and thereafter forming a dispersed carbonated complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction by the alkylation of aromatic hydrocarbons as for example those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms. For example, haloparaffins, olefins obtained by dehydrogenation of paraffins polyolefin polymers produced from ethylene, propylene, etc., are all suitable. The alkaryl sulfonates usually contain from about 9 to about 70 or more carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, strontium and barium. Examples are calcium oxide, calcium hydroxide, magnesium oxide, magnesium acetate and magnesium borate. As noted, the alkaline earth metal compound is used in excess of that required to complete neutralization of the alkaryl sulfonic acids. Generally, the amount ranges from about 100 to 220 percent, although it is preferred to use at least 125 percent, of the stoichiometric amount of metal required for complete neutralization.

Various other preparations of basic alkaline earth metal alkaryl sulfonates are known, such as U.S. Pat. Nos. 3,150,088 and 3,150,089 wherein overbasing is accomplished by hydrolysis of an alkoxide carbonate complex with the alkaryl sulfonate in a hydrocarbon solvent-diluent oil.

A preferred alkaline earth sulfonate additive is magnesium alkyl aromatic sulfonate having a high total base number ("TBN") ranging from about 300 to about 400 with the magnesium sulfonate content ranging from about 25 to about 32 weight percent, based upon the total weight of the additive system dispersed in mineral lubricating oil.

Neutral metal sulfonates are frequently used as rust inhibitors. Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylatese and naphthenates can be realized by utilizing alkaline earth metal e.g., calcium, salts of mixtures of $C_8$–$C_{26}$ alkyl salicylates and phenates (see '069) or polyvalent metal salts of alkyl salicyclic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is usefully at TBN levels of between 60 and 150. Included with the useful polyvalent metal salicylate and naphthenate materials are the methylene and sulfur bridged materials which are readily derived from alkyl substituted salicylic or naphthenic acids or mixtures of either of both with alkyl substituted phenols. Basic sulfurized salicylates and a method for their preparation is shown in U.S. Pat. No. 3,595,791. Such materials include alkaline earth metal, particularly magnesium, calcium, strontium and barium salts of aromatic acids having the general formula:

$$HOOC—ArR^4—X_y—(ArR^4—OH)_n \quad (V)$$

where Ar is an aryl radical of 1 to 6 rings, $R^4$ is an alkyl group having from about 8 to 50 carbon atoms, preferable 12 to 30 carbon atoms (optimally about 12), X is a sulfur (—S—) or methylene (—$CH_2$—) bridge, y is a number from 0 to 4 and n is a number from 0 to 4.

Preparation of the overbased methylene bridged salicylate-phenate salt is readily carried out by conventional techniques such as by alkylation of a phenol followed by phenation, carboxylation, hydrolysis, methylene bridging a coupling agent such as an alkylene dihalide followed by salt formation concurrent with carbonation. An overbased calcium salt of a methylene bridged phenol-salicylic acid of the general formula:

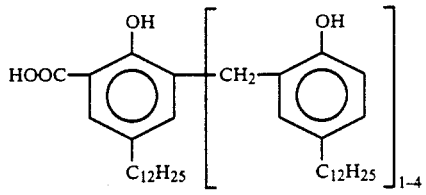

(VI)

with a TBN of 60 to 150 is highly useful in this invention.

The sulfurized metal phenates can be considered the "metal salt of a phenol sulfide" which thus refers to a metal salt whether neutral or basic, of a compound typified by the general formula:

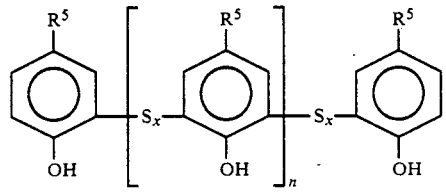

(VII)

wherein x=1 or 2, n=0, 1 or 2; or a polymeric form of such a compound, wherein $R^5$ is an alkyl radical, n and x are each integers from 1 to 4, and the average number of carbon atoms in all of the $R^5$ groups is at least about 9 in order to ensure adequate solubility in oil. The individual $R^5$ groups may each contain from 5 to 40, preferably 8 to 20, carbon atoms. The metal salt is prepared by reacting an alkyl phenol sulfide with a sufficient quantity of metal containing material to impart the desired all to the sulfurized metal phenate.

Regardless of the manner in which they are prepared, the sulfurized alkyl phenols which are useful generally contain from about 2 to 14 percent by weight, preferably about 4 to about 12 weight percent sulfur based on the weight of sulfurized alkyl phenol.

The sulfurized alkyl phenol may be converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometric, e.g., basic sulfurized metal dodecyl phenate has a metal content up to (or greater) than 100 percent in excess of the metal present in the corresponding normal sulfurized metal phenate. The excess metal is produced in oil-soluble or dispersible form (as by reaction with $CO_2$).

C. ANTIOXIDANTS

Materials which have been observed to be effective antioxidants in lubricating oil compositions are oil-soluble copper compounds, e.g., Cu, in the form of synthetic or natrual carboxylic acid Cu salts. Examples include $C_{10}$ to $C_{18}$ fatty acids such as stearic or palmitic acid. But unsaturated acids (such as oleic acid), branched carboxylic acids (such as naphthenic acids) of molecular weight from 200 to 500 and, synthetic carboxylic acids are all used because of the acceptable handling and solubility properties of the resulting copper carboxylates. Suitable oil soluble dithiocarbamates have the general formula $(R^6 R^7 N C SS)_n Cu$; where n is 1 or 2 and $R^6$ and $R^7$ may be the same of different and are hydrocarbyl radicals containing from 1 to 18 carbon atoms and including radicals such as alkyl, alkenyl, aryl, aralkyl, alkaryl and cycloaliphatic radicals. Particularly preferred as $R^6$ and $R^7$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethyl-hexyl, phenyl, butyl-phenyl, cyclohexyl, methylcyclopentyl, propenyl, butenyl, etc. In order to obtain oil solubility, the total number of carbon atoms (i.e., $R^6$ and $R^7$) generally should be about 5 or greater.

Copper sulphonates, phenates, and acetyl acetonates may also be used.

Exemplary of useful copper compounds are copper ($Cu^I$ and/or $Cu^{II}$) salts of alkenyl succinic acids or anhydrides. The salts themselves may be basic, neutral or acidic. They may be formed by reacting (a) any of the materials discussed above in the Ashless Dispersant-A(i) section, which have at least one free carboxylic acid group with (b) a reactive metal compound. Suitable reactive metal compounds include those such as cupric or cuprous hydroxides, oxides, acetates, borates, and carbonates or basic copper carbonate.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{+2}$. The preferred substrates are polyalkenyl succinic acids in which the alkenyl group has a molecular weight greater than about 700. The alkenyl group desirably has a $\overline{M}_n$ from about 900 to 1,400, and up to 2,500, with a $\overline{M}_n$ of about 950 being most preferred. Especially preferred, of those listed above in the section on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° C. and about 200° C. Temperatures of 110° C. to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper antioxidants (e.g., Cu-PIBSA, Cu-oleate, or mixtures thereof) will be generally employed in an amount of from about 50–500 ppm by weight of the metal, in the final lubricating or fuel composition.

D. ANTIWEAR ADDITIVES

Dihydrocarbyl dithiophosphate metal salts are frequently added to lubricating oil compositions as antiwear agents. They also provide antioxidant activity. The zinc salts are most commonly used in lubricating oil in amounts of 0.1 to 10, preferably 0.2 to 2 weight percent, based upon the total weight of the lubricating oil composition. They may be prepared in accordance with known techniques by first forming a dithiophosphoric acid, usually by reaction of an alcohol or a phenol with $P_2S_5$ and then neutralizing the dithiophosphoric acid with a suitable zinc compound.

Mixtures of alcohols may be used including mixtures of primary and secondary alcohols; secondary alcohols are generally for imparting improved antiwear properties and primary alcohols giving improved thermal stability properties. Mixtures of the two are particularly useful. In general, any basic or neutral zinc compound could be used but the oxides, hydroxides and carbonates are most generally employed. Commercial additives frequently contain an excess of zinc due to use of an excess of the basic zinc compound in the neutralization reaction.

The zinc dihydrocarbyl dithiophosphates useful in the present invention are oil soluble salts of dihydrocarbyl esters of dithiophosphoric acids and may be represented by the following formula:

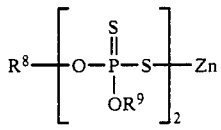

(VIII)

wherein $R^8$ and $R^9$ may be the same or different and are hydrocarbyl radicals containing from 1 to 18, preferable 2 to 12 carbon atoms and including radicals such as alkyl, alkenyl, aryl, aralkyl, alkaryl and cycloalkyl radicals. Particularly preferred as $R^8$ and $R^9$ groups are alkyl groups of 2 to 8 carbon atoms. Thus, the radicals may, for example, be ethyl, n-propyl, i-propyl, n-butyl, sec-butyl, amyl, n-hexyl, i-hexyl, n-octyl, decyl, dodecyl, octadecyl, 2-ethyl-hexyl, phenyl, butyl-phenyl, cyclohexyl, methylcyclopentyl, propenyl, butenyl, etc. In order to obtain oil solubility, the total number of carbon atoms (i.e., $R^8$ and $R^9$) in the dithiophosphoric acid generally should be about 5 or greater.

E. COMPATIBILITY AIDS

The amine compatibility aids of the present invention are primary and secondary hydrocarbyl-substituted amines of the general formula $R^1R^2NH$ wherein $R^1$ and $R^2$ may be the same or different and comprise H or hydrocarbyl groups having from 4 to 20 carbon atoms, preferably 8 to 18 carbon atoms, with the proviso that at least one of $R^1$ and $R^2$ is hydrocaryl. The hydrocarbyl groups may be alkyl, alkenyl, aryl, aralkyl, alkaryl or cycloalkyl. Representative hydrocarbyl groups are $C_4$ to $C_{18}$ alkyl (e.g., butyl, tetrabutyl, isobutyl, hexyl, 2-ethylhexyl, octyl, nonyl, iso-nonyl, decyl, iso-decyl, dodecyl, undecyl, octadecyl, heptadecyl), $C_4$ to $C_{18}$ alkenyl (e.g., isobutenyl, butenyl, heptenyl, pentenyl, hexenyl, octenyl, nonenyl, decenyl, undecenyl, dodecenyl, tetradecenyl, octadecenyl), $C_6$ to $C_{18}$ aryl (e.g., phenyl, naphthenyl, bisphenyl), $C_7$ to $C_{20}$ aralkyl (e.g., benzyl, methyl benzyl, ethyl benzyl, naphthyl methyl), $C_7$ to $C_{20}$ alkaryl (e.g., tolyl, xylyl, nonyl phenyl, nonyl napthyl), $C_3$ to $C_{18}$ cycloalkyl (e.g., cyclopropyl, cyclobutyl, cyclopentyl, cyclohexyl, cyclopentyl, cyclooctyl, cyclodecyl, cyclododecyl), and the like. The hydrocarbyl groups may be substituted with alkoxy or thioalkoxy groups (e.g., $C_1$ to $C_6$ alkoxy or thioalkoxy), but should be free of substitution by hydroxy groups since such groups could interfere with the compatibility function. While such $R^1$ and $R^2$ should be predominantly hydrocarbyl, up to 20 percent of the carbon atoms in any $R^1$ or $R^2$ group may be replaced by a sulfur or by ether-bonded oxygen atoms. The total number of carbon atoms in the amine (that is the sum of the carbons in $R^1$ and $R^2$) should be 8 or more to provide adequate solubility in the base oil. The amines also provide substantial antioxidant activity of their own.

Exemplary of amine compatibilizers of this invention are:

| Primary amines: $R^1—NH_2$ | |
|---|---|
| Octyl amine | Undecyl amine |
| Nonyl amine | Heptadecyl amine |
| Omega-ethoxy hexyl amine | Tridecyl amine |
| Hexadecyl amine | Decyl amine |
| Dodecyl amine | Tetradecyl amine |
| Octadecyl amine | N-(2-ethyl hexyl phenyl)-amine |
| Omega-thiomethoxy decyl amine | N-(octyl phenyl)-amine |
| Propyl aniline | N-(di-methyl phenyl)-amine |
| Ethyl aniline | N-ethyl benzyl amine |
| N-xylyl-amine | N-cyclo octyl amine |
| N-(ethyl-cyclohexyl)-amine | N-cyclo dodecyl amine |
| N-naphthyl amine | |

| Secondary amines: $R^1—\overset{R^2}{\overset{\vert}{N}}H$ | |
|---|---|
| Ethyl hexyl amine | Di-octyl amine |
| Propyl pentyl amine | Di-(isobutyl)-amine |
| Octyl methyl amine | Di-(z-ethyl hexyl)-amine |
| Nonyl heptyl amine | Di-nonyl amine |
| Decyl dodecyl amine | Di-decyl amine |
| Phenyl Ethyl amine | Di-phenyl amine |
| Tolyl methyl amine | Di-(cyclo octyl)-amine |
| Di-(Octyl phenyl)-amine | |
| Di-(nonyl phenyl)-amine | |

Especially preferred amines are oil soluble dialkyl and dialkaryl amines. Specific preferred amines include di(alkylphenyl)-amine, di(octadecyl)-amine, di(hexyl)-amine.

These amine compatibility aids have proven to be especially valuable in lubricating oil formulations containing less than about 0.1 percent by weight of phosphorus. When the level of phosphorus, in the form of the ZDDP antiwear additives discussed above, is lowered below 0.1% these amines may be added to permit passage in the ASTM III D test.

These amines are useful in stabilizing lubricating formulations which preferably contain, in addition to high molecular weight dispersants and detergents (often having a high total base number), glycerols partially esterified with fatty acids which act as friction modifiers and/or zinc dihydrocarbyl dithiophosphate antiwear additives. Preferred amounts of amines in concentrates ("ad packs") are from about 0.5 to about 7.5 percent by weight. Especially preferred amounts fall between about 3.0 to about 6.0 percent by weight of the total concentrate when used with a friction modifier, or 1.5 to 3.0 percent by weight when used in concenrates ("ad packs") without the friction modifier. These combinations of materials, i.e., copper materials, dispersants, detergents, antiwear additives and friction modifiers are notoriously difficult to maintain in a homogenous form in a concentrate especially after storage at elevated temperatures. The amines noted as part of this invention are facile in stabilizing even these troublesome combinations.

LUBRICANT OIL BASESTOCK

The ashless dispersant, metal detergent and amine compatibilizing agent will be employed in admixture with a lube oil basestock, comprising an oil of lubricating viscosity, including natural and synthetic lubricating oils and mixtures thereof.

Natural oils include animal oils and vegetable oils (e.g., castor, lard oil) liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhxyl)benzenes); polyphenyls (e.g., biphenyls, terphenyls, alkylated polyphenols); and alkylated diphenyl ethers and alkylated diphenyl sulfides and the derivatives, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, the alkyl and aryl ethers of these polyoxyalkylene polymers (e.g., methyl-polyisopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol and tripentaerythritol.

Silicon-based oils such as the polyalkyl-, polyaryl-, polyalkoxy-, or polyaryloxysiloxne oils and silicate oils comprise another useful class of synthetic lubricants; they include tetraethyl silicate, tetraisopropyl silicate, tetra-(2-ethylhexyl)silicate, tetra-(4-methyl-2-ethylhexyl)silicate, tetra-(p-tert-butylphenyl)silicate, hexa-(4-methyl-2-pentoxy)disiloxane, poly(methyl)siloxanes and poly(methylphenyl)siloxanes. Other synthetic lubricating oils include liquid esters of phosphorus-containing acids (e.g., tricresyl phosphate, trioctyl phosphate, diethyl ester of decylphosphonic acid) and polymeric tetrahydrofurans.

Unrefined, refined and rerefined oils can be used in the lubricants of the present invention. Unrefined oils are those obtained directly from a natural or synthetic source without further purification treatment. For example, a shale oil obtained directly from retorting operations, a petroleum oil obtained directly from distillation or ester oil obtained directly from an esterification process and used without further treatment would be an unrefined oil. Refined oils are similar to the unrefined oils except they have been further treated in one or more purification steps to improve one or more properties. Many such purification techniques, such as distillation, solvent extraction, acid or base extraction, filtration and percolation are known to those skilled in the art. Rerefined oils are obtained by processes similar to those used to obtain refined oils applied to refined oils which have been already used in service. Such rerefined oils are also known as reclaimed or reprocessed oils and often are additionally processed by techniques for removal of spent additives and oil breakdown products.

The stabilized concentrates of this invention will generally comprise ashless dispersant, overbased metal detergent, copper antioxidant compound and amine compatibilizer, and optional antiwear additives and friction modifiers in the following amounts:

| Wt. % (A.I.) | Broad | Preferred | Most Preferred |
|---|---|---|---|
| A. Ashless dispersant (e.g., PIBSA-PAM) | 0.1 to 85 wt. % | 3 to 75 wt. % | 10 to 50 wt. % |
| B. Overbased metal detergent (e.g., Mg or Ca sulfonates/phenates, 200–450 TBN) | 0.1 to 80 wt. % | 0.2 to 50 wt. % | 2 to 40 wt. % |
| C. Cu antioxidants (e.g., $Cu(oleate)_2$, $Cu(acetate)_2$, $Cu\text{-}(PIBSA)_2$) | 0.001 to 5 wt. % | 0.01 to 2.0 wt. % | 0.1 to 1.0 wt. % |
| D. Amine Compatibilizers | 0.001 to 20 wt. % | 0.1 to 10 wt. % | 0.1 to 7 wt. % |
| PREFERRED OPTIONAL ADDITIVES | | | |
| E. ZDDP (e.g., zinc diethylhexyl dithiophosphate) | 0.01 to 50 wt. % | 1 to 40 wt. % | 5 to 20 wt. % |
| F. Friction modifiers (e.g., glycerol mono-oleate, di-oleate) | 0.01 to 15 wt. % | 0.1 to 10 wt. % | 0.2 to 5 wt. % |

Generally, the ashless dispersant and overbased metal detergent will be employed in the above concentrates in an ashless dispersant: overbased metal detergent wt: wt ratio of from about 0.2:1 to 5:1 (on an A.I. basis).

This invention has been described by specific disclosures and by examples. It will be apparent to those skilled in the art that various changes and modifications to the claimed invention can be made which fall into the scope of equivalents.

EXAMPLES

Examples 1-3

Three typical additive package concentrates ("ad packs") were formulated using the following materials:

ashless nitrogen-containing dispersant (PIBSA-PAM);
overbased magnesium sulfonate;
zinc dialkyl dithiophosphate (ZDDP) antiwear material;
nonyl phenyl sulfide;
cupric oleate antioxidant; and
diluent oil.

The three ad packs compositions comprised:

TABLE I

| Components | Wt. % A.I. in Concentrate Ex. 1 | Ex. 2 | Ex. 3 |
|---|---|---|---|
| Total: dispersant, overbased sulfonate detergent, ZDDP, nonyl phenyl sulfide and diluent oil | 98.2 | 97.2 | 96.0 |
| Cupric Oleate | 1.8 | 1.5 | 1.5 |
| di(nonyl phenyl)-amine | 0 | 1.3 | 2.5 |

Each ad pack was then admixed with sufficient S150ON lubricating oil to provide a finished oil formulation containing 7.3% by volume of the ad pack. In Example 1, the finished oil formulation contained cupric oleate in an amount of approximately 150 ppm copper. The ZDDP concentration in the ad pack was selected to provide about 0.08% by weight of phosphorus in the finished lubricant.

Two additional formulations, similar to that in Example 1, were mixed. A portion of the cupric oleate was removed and a commercial antioxidant, di(nonyl phenyl)amine (VANLUBE DND; R. T. Vanderbilt Co., Inc.) was added in its place as a supplementary antioxidant. The Example 2 ad pack contained sufficient di(nonyl phenyl)-amine to yield approximately 0.1% by weight amine in the finished lubricating composition. The Example 3 ad pack contained a level of di(nonyl phenyl)-amine sufficient to result in approximately 0.2% by weight of the amine in the final lubricating composition.

The three formulations were then subjected to an accelerated stability test. This test is designed to provide an indication of stability, i.e., the propensity of the mixture to stay in a single homogeneous phase. The test involves the step of holding the formulations at an elevated temperature (e.g., 54° to 66° C.) for a protracted period of time. Unstable ad packs will develop sediment, haze, or various degrees of phase separation depending on their inherent storage stability.

The Example 1-3 formulations provided the following results:

TABLE II

| Example No. | Stability (days to appearance of haze or sediment) 54° C. | 66° C. |
|---|---|---|
| Ex. 1 (comparative) | 11 | 4 |
| Ex. 2 | 68 | 33 |
| Ex. 3 | >90 | >90 (test terminated) |

These examples demonstrated that even at low levels of amine addition, the stability improvement is substantial. At higher levels of addition, the additive package was completely stable, as reflected in Example 3.

Examples 4–16

In separate runs, additional additive packages were formulated including a commercial friction modifier containing primarily glycerol mono-oleate.

Addition of the friction modifier results in a concentrate that is notoriously unstable. As an indication of that instability, it was noted that the formulation of Example 5, which contains the friction modifier, and which is quite similar in composition to the formulation of Example 3 above (except for the addition of the friction modifier), is considerably less stable than the Example 3 formulation.

In this series of examples, the cupric oleate concentration is held approximately constant. The compositions of the formulations in Examples 4–14 are summarized in Table III below, as are the results of the respective stability tests.

This Table demonstrates that amines provide improved ad pack stability. The various examples show that the results can be obtained in formulations with and without friction modifiers.

TABLE III

| Components (wt. % A.I.) | Ex. 4 | Ex. 5 | Ex. 6 | Ex. 7 | Ex. 8 | Ex. 9 | Ex. 10 | Ex. 11 | Ex. 12 | Ex. 13 | Ex. 14 |
|---|---|---|---|---|---|---|---|---|---|---|---|
| (The Components of Example 1-3 plus Friction Modifier and Diluent Oil) | 98.5 | 96.1 | 94.2 | 96.1 | 94.2 | 96.1 | 94.2 | 96.1 | 94.2 | 96.1 | 94.2 |
| Cupric Oleate | 1.5 | 1.5 | 1.5 | 1.5 | 1.5 | 1.5 | 1.5 | 1.5 | 1.5 | 1.5 | 1.5 |
| Amine Compatibility Aids: | 0.0 | | | | | | | | | | |
| Di(nonyl phenyl amine)[1] | | 2.4 | 4.3 | | | | | | | | |
| Di(octyl phenyl amine)[2] | | | | 2.4 | 4.3 | | | | | | |
| Mixed diphenylamines[3] | | | | | | 2.4 | 4.3 | | | | |
| Di(octadecyl)amine | | | | | | | | 2.4 | 4.3 | | |
| Di(hexyl)amine | | | | | | | | | | 2.4 | 4.3 |
| Stability (Days) | | | | | | | | | | | |
| 130° F. (54.4° C.) | unstable | 4 | >60 | 60 | 60 | 4 | 60 | 4 | >60 | >60 | >60 |
| 150° F. (65.6° C.) | unstable | 1 | 18 | 25 | 25 | 1 | 18 | 1 | >60 | >60 | >60 |

NOTES:
[1]Vanlube DND; R. T. Vanderbilt Co., Inc.
[2]Vanlube SL; R. T. Vanderbilt Co., Inc.
[3]Irganox L57; Ciba-Geigy Corp.

We claim as our invention:

1. A composition comprising:

(a) an ashless ester containing dispersant compound selected from the group consisting of oil soluble oxazolines and esters, or mixtures thereof, of long chain hydrocarbon substituted mono- and dicarboxylic acids or their anhydrides; wherein said long chain hydrocarbon group is a polymer of a $C_2$ to $C_5$ monoolefin, said polymer having a number average molecular weight of about 700 to 5000;

(b) a high total base number detergent material;

(c) an oil soluble copper containing antioxidant material; and (d) an amine compatibilizing material of the formula:

$$R^1-\overset{\overset{\displaystyle R^2}{|}}{N}H$$

wherein $R^1$ and $R^2$ are independently H or hydrocarbyl groups, having from 4 to 20 carbon atoms, selected from substituted or unsubstituted alkyl, alkenyl, aralkyl, or cycloalkyl groups; and wherein $R^1$ and $R^2$ are not both H and together contain at least 8 atoms.

2. The composition of claim 1 wherein $R^1$ and $R^2$ each contain 8–20 carbon atoms.

3. The composition of claim 1 wherein the amine is a dialkylamine.

4. The composition of claim 3 wherein the amine is dioctadecylamine.

5. The composition of claim 1 wherein the amine is dihexylamine.

6. The composition of claim 1 also containing an antiwear additive.

7. The composition of claim 6 wherein the antiwear additive is zinc dialkyl dithiophosphate.

8. The composition of any of claims 1 to wherein the copper containing antioxidant material is a copper carboxylate.

9. The composition of claim 8 wherein the copper carboxylate is copper oleate.

10. The composition of claim 8 wherein the copper carboxylate is copper laurate.

11. The composition of claim 8 wherein the copper carboxylate is a copper naphthenate.

12. The composition of claim 1 also containing a major amount of a lubricating oil.

13. The composition of claim 1 also containing a major amount of a fuel oil.

14. A composition comprising:

(a) an ashless ester containing dispersant material formed by reacting olefin polymer of $C_2$ to $C_{10}$ mono-olefin having a number average molecular weight greater than about 1,300 and a $C_4$ to $C_{10}$ monounsaturated acid material followed by reacting the resulting hydrocarbyl substituted $C_4$ to $C_{10}$ monounsaturated dicarboxylic acid producing material with at least one monohydric and polyhydric alcohols;

(b) a high total base number detergent material;

(c) a copper containing antioxidant material;

(d) a friction modifier; and (e) an amine compatibilizing material of the formula:

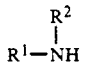

wherein $R^1$ and $R^2$ are independently H or hydrocarbyl groups, having from 4 to 20 carbon atoms, selected from substituted or unsubstituted alkyl, alkenyl, aralkyl, or cycloalkyl groups; and wherein $R^1$ and $R^2$ are not both H and together contain at least 8 carbon atoms.

15. The composition of claim 14 wherein the friction modifier is a glycerol partially esterified with fatty acids.

16. The composition of claim 14 wherein $R_1$ and $R_2$ each contain 8 to 20 carbon atoms.

17. The composition of claim 14 wherein the amine compatibilizing material comprises a dialkylamine.

18. The composition of claim 17 wherein the amine compatibilizing material comprises a member selected from the group consisting of di(octadecyl)amine, and dihexyl amine.

19. The composition of claim 14 wherein said ashless dispersant comprises polyisobutenyl succinimide.

20. The composition of claim 14 also containing an antiwear additive.

21. The composition of claim 20 wherein the antiwear additive is zinc dialkyl dithiophosphate.

22. The composition of any of claims 15 to 21 wherein the copper containing antioxidant material is a copper carboxylate.

23. The composition of claim 22 wherein the copper carboxylate is copper oleate.

24. The composition of claim 22 wherein the copper carboxylate is copper laurate.

25. The composition of claim 22 wherein the copper carboxylate is a copper naphthenate.

26. The composition of claim 14 also containing a major amount of a lubricating oil.

27. The composition of claim 14 also containing a major amount of a fuel oil.

28. A composition comprising:

(a) an ester dispersant material having a number average molecular weight greater than about 2000;

(b) a high total base number detergent material;

(c) a copper containing antioxidant material;

(d) a friction modifier; and (e) an amine compatibilizing material of the formula:

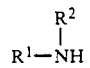

wherein $R^1$ and $R^2$ are independently H or hydrocarbyl groups, having from 4 to 20 carbon atoms, selected from substituted or unsubstituted alkyl, alkenyl, aralkyl, or cycloalkyl groups; and wherein $R^1$ and $R^2$ are not both H and together contain at least 8 carbon atoms.

29. The composition of claim 28 wherein the friction modifier is a glycerol partially esterified with fatty acids.

30. The composition of claim 28 wherein $R^1$ and $R^2$ each contain 8 to 20 carbon atoms.

31. The composition of claim 28 wherein the amine is a dialkylamine.

32. The composition of claim 31 wherein the amine is dioctadecylamine.

33. The composition of claim 28 wherein the amine is dihexylamine.

34. The composition of claim 28 also containing an antiwear additive.

35. The composition of claim 34 wherein the antiwear additive is zinc dialkyl dithiophosphate.

36. The composition of any of claims 28 to 33 wherein the copper containing antioxidant material is a copper carboxylate.

37. The composition of claim 36 wherein the copper carboxylate is copper oleate.

38. The composition of claim 36 wherein the copper carboxylate is copper laurate.

39. The composition of claim 36 wherein the copper carboxylate is a copper naphthenate.

40. The composition of claim 28 also containing a major amount of a lubricating oil.

41. The composition of claim 28 also containing a major amount of a fuel oil.

* * * * *